US005235819A

United States Patent [19]

Bruce

[11] Patent Number: 5,235,819

[45] Date of Patent: Aug. 17, 1993

[54] METHOD AND APPARATUS FOR STORING AND DISTRIBUTING MATERIALS

[75] Inventor: Hans Bruce, Stockholm, Sweden

[73] Assignee: Pallet-Cooler KB, Marsta, Sweden

[21] Appl. No.: 733,323

[22] Filed: Jul. 22, 1991

Related U.S. Application Data

[63] Continuation-in-part of Ser. No. 476,480, filed as PCT/SE89/00080 on Feb. 24, 1989, Pat. No. 5,050,387.

[30] Foreign Application Priority Data

Mar. 2, 1988 [SE] Sweden ..... 8800743

[51] Int. Cl.[5] ..... B65B 63/08

[52] U.S. Cl. ..... 62/60; 62/438; 62/457.2; 62/530

[58] Field of Search ..... 62/463, 438, 372, 530, 62/457.2; 220/426, 420, 466, 467, 901

[56] References Cited

U.S. PATENT DOCUMENTS

| | | | |
|---|---|---|---|
| Re. 19,950 | 4/1936 | Rice, Jr. . | |
| 838,122 | 12/1906 | Kruse | 220/466 |
| 1,551,709 | 9/1925 | Stoll . | |
| 1,571,438 | 2/1926 | Schopf . | |
| 1,777,786 | 10/1930 | Copeman | 62/438 |
| 2,239,128 | 4/1941 | Sykes . | |
| 2,400,742 | 5/1946 | Clerc . | |
| 2,415,711 | 2/1947 | Sticelbec | 62/438 |
| 2,589,577 | 3/1952 | Rosenthal et al. . | |
| 2,781,643 | 2/1957 | Fairweather . | |
| 3,236,206 | 2/1966 | Willinger . | |
| 4,324,111 | 4/1982 | Edwards . | |
| 4,498,312 | 2/1985 | Schlosser . | |
| 4,596,250 | 6/1986 | Beisang, III et al. | 62/530 |
| 4,882,914 | 11/1989 | Haines-Keeley et al. . | |

FOREIGN PATENT DOCUMENTS

| | | |
|---|---|---|
| 0139812 | 3/1984 | European Pat. Off. . |
| 0157751 | 9/1985 | European Pat. Off. . |
| 2303734 | 10/1976 | France . |
| 454686 | 5/1988 | Sweden . |
| 2186067 | 8/1987 | United Kingdom . |

*Primary Examiner*—John M. Sollecito

*Attorney, Agent, or Firm*—Beveridge, DeGrandi, Weilacher & Young

[57] ABSTRACT

The present invention relates to a method and apparatus for maintaining products at an intended temperature during transport and storage at an ambient temperature deviating from the intended temperature. The invention features a container which holds the products and whose walls render heat transfer difficult. The container includes a main container body with a bottom and a side section that together define one or more integrated compartments suitable for storing a solidifiable substance. The container includes a lid which also has an integrated compartment for storing a solidifiable substance. When the lid is positioned on the main container body there is provided a solidifiable substance confinement enclosing the material storage space in the container from all sides. By subjecting the container and the solidifiable substance in its wall compartments (4, 4') to cold, so as to solidify the substance, subsequently inserting the products into the container after it has been moved to a room having a temperature adapted to the products, and positioning the lid over the container main body, an uninterrupted layer of solidifiable substance is provided around the entire material storage space.

15 Claims, 1 Drawing Sheet

METHOD AND APPARATUS FOR STORING AND DISTRIBUTING MATERIALS

This application is a continuation-in-part of Ser. No. 07/476,480 filed Jul. 30, 1990 in the U.S., now U.S. Pat. No. 5,050,387, and originally on Feb. 24, 1989 as PCT/SE89/00080 and entitled Method and Container for Storing and Distribution of Foodstuffs. The above-identified application is incorporated herein by reference.

FIELD OF THE INVENTION

The present invention relates to a method and apparatus for storing and distribution of material. More particularly, the present invention relates to a container which includes a compartment arrangement filed with a freezable or solidifiable substance to maintain material at or near a predetermined temperature.

BACKGROUND OF THE INVENTION

The quality of many materials is highly affected by the temperature at which the materials are stored and distributed. For example, there has been a strong trend by foodstuff producers towards producing chilled, ready-cooked dishes that preferably are retained at a temperature of about 0° C. (32° F.) as long as possible from the moment of production until the consumer buys the product in the shop. The essential thing is that the product does not reach a temperature below its freezing-point which may be lower than 0° C. if freezing-point lowering substances, such as salt, are included in the product. In fact, a slow refrigeration at a few degrees below zero deteriorates the structure and certain quality properties of the product. Likewise, flower and plant shippers find it advantageous to maintain, for example, expensive flowers at a 10° C. (50° F.) temperature to avoid premature blossoming. Various other shippers and producers require that their product be retained at a particular temperature for optimum results.

In the distribution of various materials it is difficult to maintain an unbroken chain of refrigeration (or heating when products are in a colder climate) such that the storage material retains the predetermined optimum temperature. Moreover, it is often desirable to ship simultaneously a variety of materials having different optimum temperatures. Because of the differences in optimum temperatures, however, the products either have to be shipped separately, shipped together at a compromise temperature (which can lead to losses due to product degradation), or placed in separate containers with their own cooling or heating device (which leads to added shipping costs, complexity and the possibility of one type of cooling/heating means adversely affecting a neighboring storage container).

For example, a distributor might desire to transport to a specific location a load of frozen shrimp and live lobsters. Attempts to maintain the shrimp frozen could lead to the death of the live lobsters, while attempts to maintain the lobsters at an optimum transport temperature (e.g. 4.5° C. or 40° F.) could lead to undesirable thawing of the frozen shrimp. Hence, to avoid destruction of the load and an unhappy recipient, the distributor is likely to ship separately or spend additional labor and money in attempting to position and individually refrigerate the two types of loads in a single freight carrier.

SUMMARY OF THE INVENTION

The invention is based on the idea that the material which is to be held at essentially a fixed temperature, is shut off from the surroundings and completely enclosed in a container. The container is designed in such a manner that it comprises a compartment arrangement which encloses the material storage space for the material and is designed to hold a substance whose freezing or solidification temperature is such that the material being stored in the compartment retains a predetermined optimum temperature for the anticipated storage and transport time as well as the anticipated exterior environment which is to be faced during the storage and transport period. In situations where the shipping and transport environment is at a higher temperature than the optimum product temperature, the freezable or solidifiable substance is to be of such a type that it requires, because of its physical properties, a considerable supply of heat which is taken from the products and the external environment, before its storing capacity decreases.

Water is one possible medium that is especially suited for materials which are to be maintained at 0° C. For material which is to be maintained at a predetermined temperature below 0° C. an additive such as salt can be added to lower the freezing temperature of the freezable substance. Moreover, in situations where it is desirable to maintain the temperature of the product above 0° C., such as for the above-noted live lobster and blossoming flower products, a solidifiable substance having a higher solidification temperature is utilized. For example, paraffin hydrocarbon compounds such as tetradecane, pentadecane and hexadecane with solidification temperatures of 5.8°, 9.7° and 18.0° C. or 42.5°, 49.5° and 64.5° F., respectively, can be relied upon. Various hydrocarbon alcohol compounds are also possible alternatives for solidifiable substances which solidify above 0° C.

The freezable or solidifying substance is also chosen to achieve an insulating effect which prevents cold temperatures in the environment from adverse affecting the product. For example, to prevent a +4° C. or colder environment from adversely affecting a cargo of material such as plants or live lobsters, the solidifiable solution is chosen so as to solidify at or near +5° C. temperature and maintain the products insulated at the predetermined optimum temperature +5° C.

The present invention is also designed for easy loading of the material and for easy shipping of the container, itself.

In achieving the foregoing, the present invention utilizes a container that comprises a main container body having a bottom section and a side section with the side section extending off from the bottom section so as to define a material storing space with an open top. The side section includes an inner and outer wall and an upper edge. The bottom section also includes an inner and outer wall. The inner and outer walls and upper edge together define at least one permanently integrated, fluid-tight compartment for holding a solidifiable substance which absorbs latent heat when transforming from a solid to a liquid. Also provided is a lid that is dimensioned and arranged so as to cover the open top of the main container body and to close-off the material storing space when positioned on the main container body. The lid includes an independent and permanently integrated, fluid-tight compartment for receiving a solidifiable substance. The lid compartment and the at least one compartment defined by the inner and outer walls are dimensioned and arranged so as to, in combination, encompass the entire material holding space.

In a preferred embodiment the compartment defined by the inner and outer walls is a single continuous compartment that extends within both the side section and the bottom section.

The lid preferably includes a mid-body section and a peripheral flange section extending off from the mid-body section. The lid compartment is formed in the lid such that a portion of the lid compartment extends within the mid-body section and a portion of the lid compartment extends within the peripheral flange section. Also, the portion of the compartment that is formed in the mid-body section extends deeper in a vertical direction than the portion of the compartment formed in the peripheral flange section. The mid-body section has a periphery corresponding in size to the size of the opening in the open top of the material storing space such that the periphery of the mid-body section is in snug, frictional contact with the upper end of the inner wall of the side section when the lid is in position on the main container body.

The depth of the portion of the compartment formed in the mid-body section is preferably about two to four times the depth of the portion of the compartment formed in the peripheral flange section such that it extends partially into the upper end of the material storing space. The depth of the compartment portion in the mid-body section is also preferably about two times the thickness of the at least one compartment formed by the inner and outer walls.

In one embodiment of the present invention, the container's compartments are permanently sealed. Alternatively, the lid compartment includes a removable sealing plug which seals an aperture formed in the lid and which opens into the lid compartment. The container further comprises a removable sealing plug that seals an aperture formed in the main container body and that opens into the at least one compartment formed by the inner and outer walls and upper edge of the main container body.

The side section of the container is preferably formed with four sides such that the inner and outer walls of the side section are quadrilateral in cross-section. The advantages of the present invention are also possible, however, with a variety of other forms such as a cylindrical shaped side section.

In an alternate embodiment of the invention, the main container body includes a plurality of internal walls extending transversely between the inner and outer walls. The internal walls are arranged so as to define a plurality of horizontal cavities in fluid communication with one another. Fluid communication can be accomplished by staggering the horizontal, internal walls so that an opening is provided at one end of a horizontal internal wall at one level and at an opposite end of an above and below positioned internal wall.

The main body container and the lid also comprise, in one embodiment of the invention, an external layer of insulating material to help insulate the material and the material storage space. The compartments with the solidified solidifiable substance are, however, sufficient for many uses without the requirement of added insulation.

One embodiment of the invention features an outer wall which is thicker than the inner wall and an interior surface of the outer wall is provided with a plurality of recesses which form a plurality of compartments for the solidifiable substance. The inner wall is positioned so as to cover the plurality of recesses and to seal the solidifiable substance in the multiple recesses. The recesses formed in the outer wall are hemispherical recesses which are arranged in vertical rows with recesses in one row being offset with recesses in an adjacent row. The container is also preferably provided with a metallic sheet joined to an interior side of the inner wall.

One solidifiable substance which is suitable for use in the lid and main container body compartments is a paraffin hydrocarbon such as tetradecane, pentadecane, and hexadecane. A additional solidifiable substance which can be relied upon for certain temperature ranges is a hydrocarbon alcohol such as DUBANOL, a product of the SHELL Corporation.

The method of the present invention for maintaining during shipping and storing a material at essentially a predetermined temperature comprises positioning a main container body, which has the at least one fluid-tight, permanently integrated compartment with a solidifiable substance therein, in an environment such as a freezer which causes the solidifiable substance to solidify. The lid is also positioned in an environment which causes the solidifiable substance in the lid compartment to solidify.

The material to be maintained essentially at the predetermined temperature is then placed within the material storage space in the main container body and the lid is positioned on the main body container so as to close-off the material storage space such that the compartment in the lid containing the solidified solidifiable substance and the at least one compartment in the main body containing the solidified solidifiable substance, together, completely encompass the entire material storage space within which the material is contained.

BRIEF DESCRIPTION OF THE DRAWINGS

The invention will now be described in detail with reference to the accompanying drawings in which.

Figure 1:
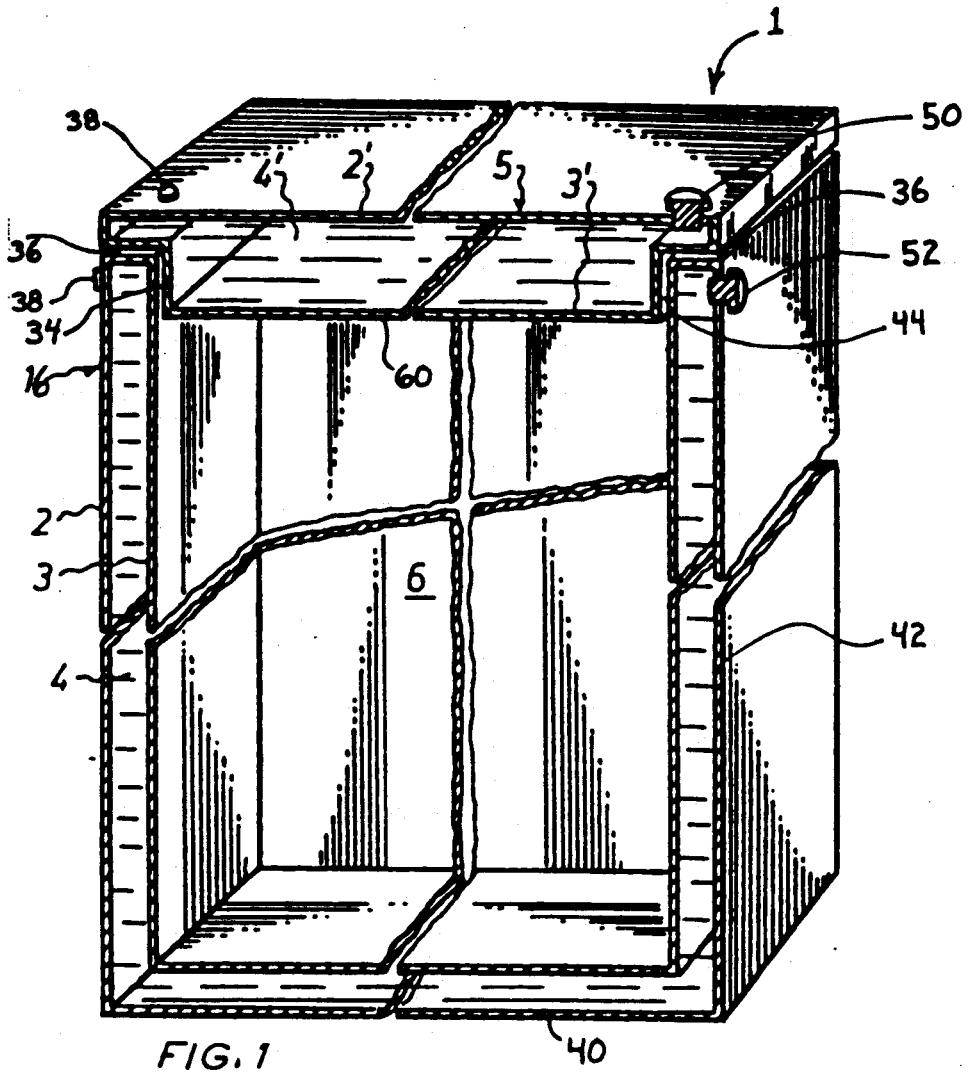
FIG. 1 is a schematic perspective view, partly in section, of a container adapted to the method according to the invention.

The container 1 comprises lid 5 and main container body 16. Main container body 16 features bottom section 40 and side section 42. Side section 42 extends upwardly off bottom section 40 and includes open-top 44. Both bottom section 40 and side section 42 include inner and outer walls which are represented in FIG. 1 by reference numbers 2 and 3. In the embodiment shown in FIG. 1, inner and outer walls 2 and 3, together with upper edge 36, define a compartment which is continuous such that it extends through the bottom section 40 and the side section 42.

Side section 42 is shown in FIG. 1 to have four sides and thus is quadralateral in cross-section. Inner wall 3 of side section 42 defines material storage space 6 within which material to be stored or transported is positioned. Compartment 4 is further illustrated to extend right up to and in contact with upper edge 36.

Lid 5 is provided with an outer wall 2' and an inner wall 3' which defines lid compartment 4'. In a preferred embodiment, lid compartment 4' is sealed with removable plug 50 which, for instance, is threadably received within one of the walls 2' or 3'. Main container body 16 is also provided with removable plug 52 which is threadably received within an upper end of side section 16 and which opens into compartment 4. Additional removable plugs 38 can be provided on lid 5 and container body 16 so as to provide for the exit and entry of air during filling and emptying of a solidifiable substance. In this way, container 1 can be more easily used for a variety of different products (e.g., the conversion of a container using water as the solidifiable substance to a substance such as tetradecane which is more suitable for products that are to be maintained at or close to 5.8° C.).

As shown in FIG. 1, lid 5 includes hollow peripheral flange section 62 which, in combination with vertical peripheral wall 34, forms a cut-out that receives the upper edge 36 of main container body 16. Further, lid 5 has mid-body section 60 from which peripheral flange section 62 extends. The vertical depth of the compartment portion within mid-body section 60 is about two to four times that of the portion of the compartment extending within the peripheral flange section 62. This added thickness in the compartment within mid-body section 60 provides an additional degree of protection as much of the heat entry (or loss in colder climates) occurs in the area where lid 5 engages upper edge 36 of main-body container 16. The depth of mid-body section 60 and the frictional contact between the peripheral wall 34 and inner wall 3 helps avoid heat loss or entry into material storage space 6.

Also, the thickness of compartment 4 in main container body 16 is preferably about one-half the thickness of the compartment portion in mid-body section 60 in lid compartment 5. If added protection is further deemed desirable, sealing means (not shown) such as an elastomeric seal placed between rim 36 and flange 62 or interengaging molded surfaces (e.g., saw tooth, labyrinth) can be provided in the contacting surfaces of flange 62 and upper edge 36.

With lid 5 in position, the thickened compartment in mid-body section 60 extends below upper edge 36 to close-off material storage space 6. With lid 5 in place, any material placed in storage space 6 is completely surrounded and insulated by an essentially continuous layer of solidifiable substance. In other words, compartment 4 and 4' are dimensioned and arranged so as to combine together to form an encompassing insulating layer of a solidifiable substance which is above, below, and on each vertical side of the product in storage space 6. This same uninterrupted layer of solidifiable substance can also be provided when main container body 16 is cylindrical and lid 5 is circular with a downwardly vertical compartment wall having an outside diameter corresponding to the inside diameter of the open top in the underlying main container body.

The material of the container is of such a nature that it withstands considerable variations in temperature and is not impaired by the explosive effect which arises when a water containing solidifying substance located in the wall, bottom and lid compartments 4, 4' solidifies and expands.

Both the outer and the inner layer 2, 3 and 2', 3' can be made of materials having a heat-insulating capacity, for example materials having a cell structure, but the insulating capacity is not always necessary as, in most instances, the insulating capacity of the solidifiable substance is sufficient.

A suitable material for the main body container and lid includes HO polyethylene or polypropylene as it is durable for handling the rough treatment associated with freight carrying and is sufficiently adaptable to handle the explosive effect of some of the solidifiable substance usable in the compartments. Such material can easily be injection molded to form the components of the present invention. If the container of the present invention is to be strictly used with a solidifiable substance that does not expand upon solidification then a less flexible material such as aluminum sheet metal can be relied upon.

If additional insulation is desirable, a suitable cell structure material such as expanded polystyrene plastic can be utilized.

The freezable or solidifiable substance is chosen based on the requirements anticipated of the container. That is, the solidifying substance is chosen based on the heat consumption required to transform the solidified substance back to a liquid or the heat developed in converting the liquid to a solid. Water is especially suited for maintaining cooked foodstuffs at or just above 0° C. and is relatively inexpensive and safe to use. As noted above, the addition of salt (e.g., sodium chloride) to water can be used to drop the freezing point temperature for products suited for temperatures below 0° C. (e.g., non-living seafood). Suitable solidifiable substances used with products having an optimum temperature above 0° C. includes normal paraffin hydrocarbons such as tetradecane, pentadecane and hexadecane or hydrocarbon alcohols such as SHELL's DUBANOL or the like.

Provided in Table I below are some representations of solidifiable substances and some of their appropriate uses.

TABLE I

| Solidifiable Material | Chemical Formula | Solidifying or Freezing Temp. °C. | Solidifying or Freezing Temp. °F. | Exemplatory Uses |
|---|---|---|---|---|
| Salt Water | $H_2O$ w/$NaCl_2$ | −21.2 | −6.2 | Icecream |
| Salt Water | $H_2O$ w/$NaNO_3$ sodium nitrate | −18.5 | −1.2 | Deep frozen food |
| Salt Water | $H_2O$ w/$NH_4Cl$ ammonium chloride | −15.8 | 3.7 | Frozen food |
| Salt Water | $H_2O$ w/KCl potassium chloride | −11.1 | 11.8 | Frozen food |
| Salt Water | $H_2O$ w/ $Na_2SO_4$ Sodium sulphate | −1.7 | 29 | Salmon, fat fishes |
| Water | $H_2O$ | 0 | 32 | Ready |

TABLE I-continued

| Solidifiable Material | Chemical Formula | Solidifying or Freezing Temp. °C. | Solidifying or Freezing Temp. °F. | Exemplatory Uses |
|---|---|---|---|---|
| | | | | cooked food dishes, and other perishables fresh fish |
| Tetradecane | $CH_3(CH_2)_{12}—CH_3$ | 5.5 to 5.8 | 41.9 to 42.4 | Live seafood, flowers, and other perishables |
| Pentadecane | $CH_3(CH_2)_{13}—CH_3$ | 9.7 to 10 | 49.5 to 50 | Fruits and flowers |
| Hexadecane | $CH_3(CH_2)_{14}—CH_3$ | 18.0 | 64.4 | Chocolate |

For some goods very high containers are used, and then the height of the container causes a relatively high pressure in the lower portion of the compartment 4, if the different portions of the compartments 4 communicate with each other. The increase of pressure in the lower portions requires greater strength and stability of the outer and inner walls or layers 2 and 3 and may also require bracing of the walls or layers to make it possible to keep their thickness within reasonable dimensions.

Figure 2:
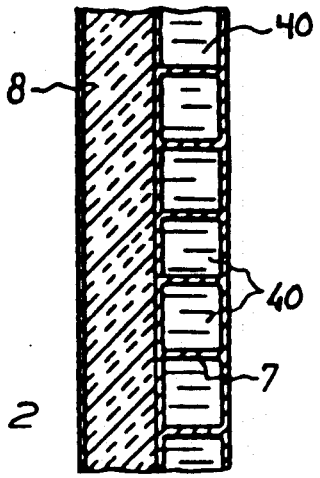
FIG. 2 is a cross-sectional view of a portion of the side section in a modified embodiment.
Figure 3:
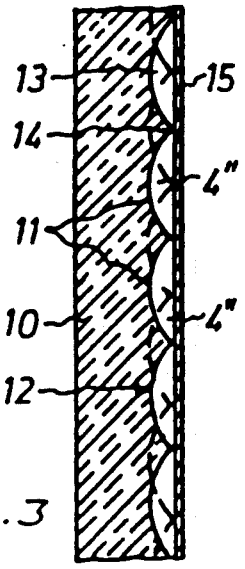
FIG. 3 is a similar cross-sectional view of a portion of the side section in another modified embodiment.

In order to overcome the drawbacks of the pressure build-up caused by the height/depth of the compartment space, the container can be arranged as shown in FIGS. 2 and 3. Instead of walls with a coherent or communicating compartment, the compartment is, according to the embodiment shown in FIG. 2, formed with a large number of cavities or channels 40 extending horizontally and defined by transversely extending internal walls 7. A layer 8 of insulating material is arranged along the outwardly facing side of the container wall formed of the parallel cavities. The thin channel walls 7 do not affect the cooling or melting function, but in essence, the channel-shaped cavities 40 act as a coherent space.

The side walls, the bottom and the lid provided with the parallel cavities or channels 40 can be manufactured by providing large panels with channels cut therein. The channels are then tilled with suitable solidifying material such as water or some other suitable solidifiable liquid. The ends of the channels are then closed or sealed, before the different panel portions are joined together as a container.

In the embodiment shown in FIGS. 2 and 3, it is thus not a matter of emptying the compartments 4 and 4' after each transport, but the liquid remains in the compartments permanently. The containers can be color coded or marked to indicate the solidifying material which is stored within compartments 4 (which features channels 40) and 4' of container 1. Thus, in the embodiment of FIG. 2 at least main container body 16 can be formed without screwable plugs such as those shown in FIG. 1. The small amount of liquid and, thus, the low weight imply that the return freight is not affected to any appreciable extent.

According to the embodiment in FIG. 3, the walls of the side section for container 1 are made of rigid panels 10 of an insulating material, e.g. cellular plastic.

On the inwardly facing side of the wall panels 10, a series of recesses 11 (e.g., hemispherical in shape) are arranged in rows along the entire panel surface in advance, preferably in connection with the manufacture of the panels. The recesses can, as indicated by dashed lines, be offset by half a step between the rows.

Again, in the inwardly facing side of the walls 10, shaped as indicated above, there are arranged foil sheets 12 having a large number of cushion-shaped portions 13 separated by web portions 14. Each cushion-shaped portion forms a compartment 4'' within recesses 11 which is filled with a suitable solidifiable material.

In the embodiment shown in FIG. 3, the container walls, i.e., the panels of insulating material, are joined together before the foil sheets are arranged therein. The foil sheets can be made by prior art methods for manufacturing an impact-protecting multilayer foil, except that in connection with the manufacture of the foil sheets intended for the subject matter, each compartment 4'' is filled with the desired solidifiable substance.

The filled compartments 4'' positioned closely adjacent one another will act in substantially the same manner as a wall with coherent layers of liquid as shown in FIG. 1. In each of the above-noted embodiments, lid 5 can be formed as shown in FIG. 1 or formed in the same manner as that of the side walls except, preferably, the lid is greater in thickness than the compartments in the side walls either through an added insulation layer and/or deeper recesses.

Against the inside of the foil sheet 12, there is arranged sheet 15 of aluminum or like material having excellent thermal conductivity, and through this sheet heat/cold is distributed between the different compartments 4'' of the foil sheet 12.

The container is used in the following manner. After the compartments 4, 4', 4'' or cavities 40 have been filled with a suitable solidifiable material (e.g., water, water to which is added common salt or some other freezing-point lowering agent has been added, a normal paraffin hydrocarbon or a hydrocarbon alcohol) the container is subject to a temperature which causes the solidifiable material to solidify. Subsequently, the container space 6 is filled with products to be stored/conveyed, and when being inserted, the products preferably have been conditioned to have the intended storing temperature. For example, the container may be placed in a freezer to solidify the solidifiable substance (e.g., water) while the product (e.g., a perishable food dish) is placed in a cooler to achieve the preferred temperature (e.g., 32° F.).

The previously solidified material in the container compartment 4, 4', 4'' or cavities 40 provide the required amount of cold to compensate for the transfer of heat from the surroundings to the products in the container through the container walls, when the temperature outside the container is higher than the preferred product temperature. When the outer temperature is lower, the solidifiable material has an insulating power in the opposite direction and prevents damage due to a much lower temperature in the surrounding environment. The solidifying material forms a wall enclosing the products from all sides (vertical, top and bottom).

As the product is completely encompassed by the wall of solidified material, there is required a large addition of heat for the predetermined product temperature to be changed. Since during insertion into the container space, the products hold the intended temperature, e.g., close to 0° C. for foodstuffs, there is but little heat in the products to melt or desolidify the solidified substance. The melting heat is instead received from the surroundings. The melting heat for the solidified material, e.g., the addition of heat required to convert ice into water without increasing the water temperature, is used as a retarding factor to make the storing time sufficiently long.

When the solidified material begins to convert to the liquid phase, the liquid will, according to the embodiment shown in FIG. 1, have a tendency to collect at the very bottom of the compartment 4, i.e., on a level with the part of the container space which, because of the higher density of colder air, holds the lowest temperature. The successive melting of the solidified material will thus occur in such a manner that the coldest medium—the remaining solidified material—will constantly be on the level of the container space where the temperature is most liable to rise, i.e., in the upper part.

When the storage space in the container has been emptied of its contents the solidifiable material can either be discarded in the case of water, drained into a suitable storage area or maintained in the shipping container. In the situation where the solidifiable material is discarded or stored in a suitable storage area, the return weight of the container is minimized for easy transport back to the place of origination. By the use of plastic material with suitable properties and water, the container in FIG. 1 can, of course, also be made as a disposable package, and in that case the water is emptied as the container is discarded. In the embodiments shown in FIGS. 2 and 3, the water remains in the respective compartments 4, 4' and 4".

According to the invention, a simple and effective and not very costly method is provided for storing and conveying products which require a fixed temperature level, and this is achieved without requiring the use of gases, special refrigerating machines or highly insulated containers. As long as there remains the solidified material in the container compartments 4, 4', 4" or cavities 40, the intended temperature in the interior of the container will be retained. The only thing demanded from the packing or delivering station is that it must have a cold-storage room or the like in which the containers can be prepared, i.e., be cooled to such an extent that the solidifiable material solidifies. For some uses (e.g., water) this cold-storage room might take the form of a freezer while for some of the other uses the solidifiable material chosen may require only a refrigerator or cooler. When necessary, the decreasing cold-retaining capacity can, of course, be improved during the transport in that the container is, at an intermediate storing location, placed in such a cold space that the melted solidifiable material is solidified again. The risk that the temperature will drop down to a dangerous level is decreased significantly since a large excess of cold outside the container is required before all the solidifiable material has completely solidified. The same holds true for shipping products in an environment which is colder than the desired temperature. In such situations, the products can be placed in the container while the solidifiable material is in a liquid state and the solidifiable material will solidify during shipping and, at the same time, protect the contents of the container.

The method of using solidifiable material in the liquid stage and in the solid stage, respectively, as insulation implies that a temperature around the optimum storage temperature can be maintained for a long time and that there is but a small risk that the temperature sinks below the optimum temperature if a moderate amount of cold is supplied to the container during transport and long storage.

The invention is not restricted to that described above and shown in the drawing but can be modified in various ways within the scope of the appended claims.

What is claimed is:

1. A container, comprising:

a main container body having a bottom section and side section with the side section extending off from the bottom section so as to define a material storing space with an open top, said side section including an inner wall and an outer wall and an upper edge and said bottom section including an inner and outer wall, said inner wall and outer walls and upper edge together defining at least one permanently integrated, fluid-tight compartment for holding a solidifiable substance which absorbs latent heat when transforming from a solid to a liquid;

a lid dimensioned and arranged so as to cover the open top of said main container body and close-off the material storing space when positioned on said main container body, said lid including a permanently integrated, fluid-tight compartment for receiving a solidifiable substance, and said lid compartment and said at least one compartment defined by said inner and outer walls and upper edge being dimensioned and arranged so as to, in combination, encompass the entire material holding space and wherein said outer wall of said side section is thicker than said inner wall and an interior surface of said outer wall of said side section has formed therein a plurality of recesses so as to form a plurality of individual compartments for said solidifiable substance, and said inner wall covers said plurality of recesses so as to seal the solidifiable substance within each of said individual compartments.

2. A container as recited in claim 1, wherein the recesses formed in said outer wall are hemispherical recesses which are arranged in vertical rows with recesses in one row being offset with recesses in an adjacent row.

3. A container as recited in claim 1, further comprising a metallic sheet joined to an interior side of said inner wall.

4. A container, comprising:

a main container body having a bottom section and a side section with the side section extending off from the bottom section so as to define a material storing space with an open top, said side section including an inner wall and an outer wall and an upper edge, said bottom section including an inner and outer wall, and said inner wall and outer walls together defining at least one permanently integrated, fluid-tight compartment;

a lid dimensioned and arranged so as to cover the open top of said main container body and close-off the material storing space when positioned on said main container body, said lid including a permanently integrated, fluid-tight compartment, and said lid compartment and said at least one compartment defined by said inner and outer walls and upper edge being dimensioned and arranged so as to, in combination, encompass the entire material holding space, and wherein said lid has a mid-body section and a flange section extending out form said mid-body section, said lid compartment extending within said mid-body section and said flange section such that a portion of the compartment within said mid-body section has a vertical thickness greater than a portion of the compartment in said flange section, and said mid-body section extends below the upper edge of said side section and into frictional contact with the inner wall of said side section; and a solidifiable substance contained within said fluid tight lid compartment and within said at least one fluid-tight compartment formed by said inner and outer walls and upper edge and wherein said solidifiable substance is permanently sealed within said lid compartment and within said at least one compartment formed by said inner and outer walls and upper edge.

5. A container as recited in claim 4, wherein said solidifiable substance is a paraffin hydrocarbon.

6. A container as recited in claim 4, wherein said solidifiable substance is tetradecane.

7. A container as recited in claim 4, wherein said solidifiable substance is pentadecane.

8. A container as recited in claim 4, wherein said solidifiable substance is hexadecane.

9. A container as recited in claim 4, wherein said solidifiable substance is hydrocarbon alcohol.

10. A container as recited in claim 4 wherein the portion of the compartment in said mid-body section is two to four times greater in vertical depth than the portion of the compartment in said flange section.

11. A container as recited in claim 10 wherein the portion of said compartment in said mid-body section of the lid has a thickness about twice as great as the portion of said compartment in said flange section.

12. A method for maintaining during shipping and storing a material at essentially a predetermined temperature; comprising:

positioning a main container body, having a bottom section, a side section and an upper sedge which together define a material storage space and which together include a plurality of fluid tight, permanently integrated compartments with a solidifiable substance sealed within the plurality of individual compartments by an inner wall positioned over a plurality of recesses formed in an interior surface of a thicker outer wall of said main body section, in an environment which causes the solidifiable substance to solidify;

positioning a lid, which has a permanently integrated, fluid-tight compartment, formed therein and which contains a solidifiable substance in an environment which causes the solidifiable substance in said lid compartment to solidify;

placing the material to be maintained essentially at the predetermined temperature within the material storage space in said main container body;

positioning said lid on said main body container so as to close-off the material storage space such that the compartment in said lid containing the solidified solidifiable substance and the individual compartments in said main body containing the solidified solidifiable substance together completely encompass the entire material storage space within which the material is contained, and wherein said lid includes a mid-body section and a peripheral flange section extending off said mid-body section with the compartment formed in said lid extending into both said mid-body section and said peripheral flange section, and wherein at least one compartment formed in said main container body extends up to said upper edge, and wherein the step of positioning said lid on said main body includes positioning said mid-body section partially into the material storage space and supporting said peripheral flange section with solidified solidifiable substance therein on said upper edge, and wherein positioning said lid further includes frictionally contacting the mid-body section with an inner wall of said side section below said upper edge.

13. A method as recited in claim 12, wherein said lid includes a mid-body section and a peripheral flange section extending off said mid-body section with the compartment formed in said lid extending into both said mid-body section and said peripheral flange section, and wherein said at least one compartment formed in said main container body extends up to said upper edge, and wherein the step of positioning said lid on said main body includes positioning said mid-body section partially into the material storage space and supporting said peripheral flange section on said upper edge.

14. A method as recited in claim 12, further comprising the step of placing said lid and said main body compartment in an environment having a temperature essentially the same as the predetermined temperature prior to positioning the lid in place on said main container body.

15. A method as recited in claim 12, wherein, following a period of shipping and storing, sealing plugs are removed from both said lid and said main container body and the solidifiable substance, which is in a liquid state, is removed from the lid compartment and said at least one main body container compartment.

* * * * *